US011319192B2

(12) United States Patent
Peippo et al.

(10) Patent No.: US 11,319,192 B2
(45) Date of Patent: May 3, 2022

(54) BRIDGE CRANE ARRANGEMENT

(71) Applicant: KONECRANES GLOBAL CORPORATION, Hyvinkää (FI)

(72) Inventors: Juha Peippo, Hyvinkää (FI); Kirsi Kalliokoski, Hyvinkää (FI)

(73) Assignee: KONECRANES GLOBAL CORPORATION, Hyvinkää (FI)

( * ) Notice: Subject to any disclaimer, the term of this patent is extended or adjusted under 35 U.S.C. 154(b) by 0 days.

(21) Appl. No.: 17/048,298

(22) PCT Filed: Apr. 12, 2019

(86) PCT No.: PCT/FI2019/050298
§ 371 (c)(1),
(2) Date: Oct. 16, 2020

(87) PCT Pub. No.: WO2019/202208
PCT Pub. Date: Oct. 24, 2019

(65) Prior Publication Data

US 2021/0070589 A1 Mar. 11, 2021

(30) Foreign Application Priority Data

Apr. 20, 2018 (FI) ..... 20185373

(51) Int. Cl.
*B66C 6/00* (2006.01)
*B66C 17/00* (2006.01)

(52) U.S. Cl.
CPC ..... *B66C 6/00* (2013.01); *B66C 17/00* (2013.01)

(58) Field of Classification Search
CPC .. B66C 17/00; B66C 6/00; B66C 9/16; B66C 9/10
See application file for complete search history.

(56) References Cited

U.S. PATENT DOCUMENTS 2,294,999 A 9/1942 Mitchell
4,289,076 A * 9/1981 Miller ..... B66C 17/00 104/89
(Continued)

FOREIGN PATENT DOCUMENTS

BE 893-253 A 9/1982
CN 2068498 U 1/1991
(Continued)

OTHER PUBLICATIONS

International Search Report, issued in PCT/FI2019/050298, PCT/ISA/210, dated Jun. 27, 2019.
(Continued)

*Primary Examiner* — Sang K Kim
*Assistant Examiner* — Nathaniel L Adams
(74) *Attorney, Agent, or Firm* — Birch, Stewart, Kolasch & Birch, LLP

(57) ABSTRACT

A bridge crane arrangement includes at least one main girder having a central web and a bottom flange; end girders supporting opposite ends of the main girder; a slide arranged between an end girder and the main girder, the slide allowing the movement of the end girder in relation to the main girder in at least its longitudinal direction and the rotation of the end girder and main girder in relation to each other; and a restrictor to restrict the movements between the end girder and the main girder. On the top surface of the end girder, there is arranged a support platform wider than the bottom flange, the slide includes a slide surface arranged on the top surface of the support platform and/or the bottom surface of the bottom flange, and the restrictor is arranged to the support platform on both sides of the bottom flange.

8 Claims, 2 Drawing Sheets

(56) References Cited

U.S. PATENT DOCUMENTS

Figure 1:
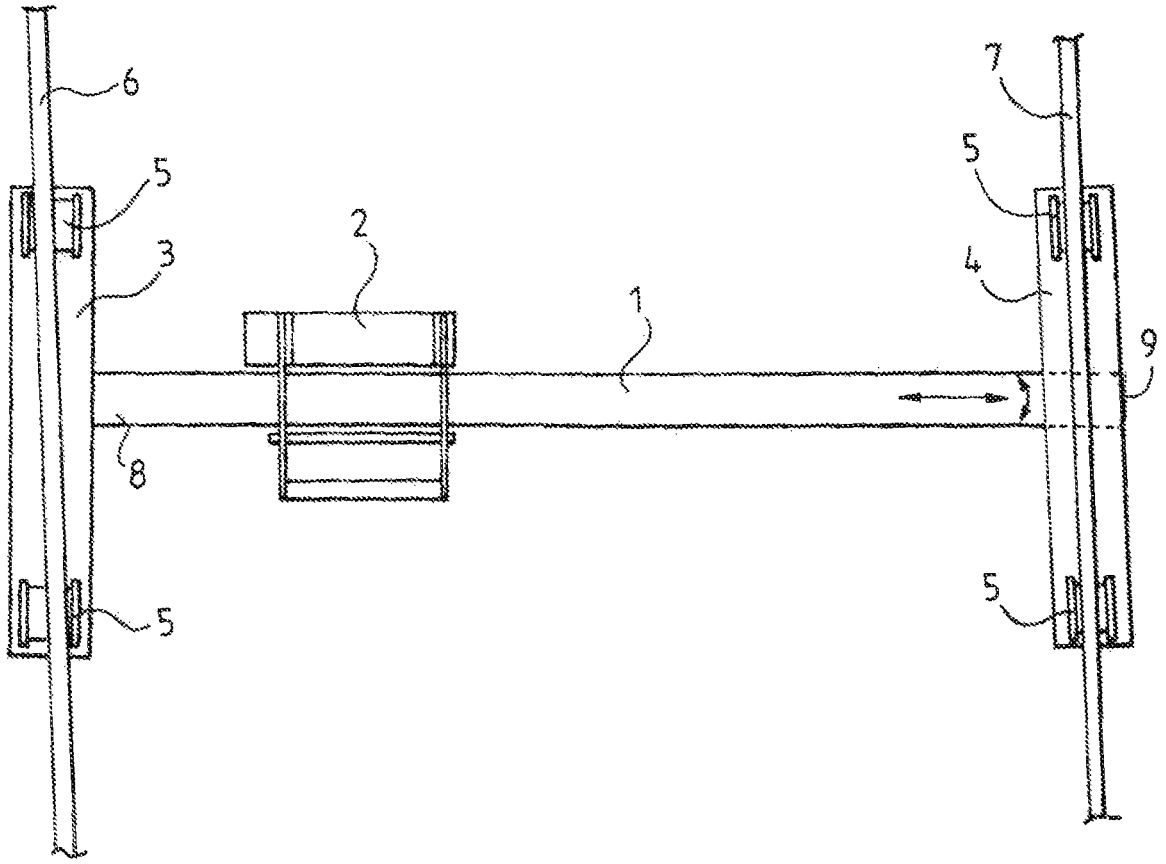

| | | | | |
|---|---|---|---|---|
| 5,080,021 | A | 1/1992 | Thorsen | |
| 6,082,562 | A * | 7/2000 | Riikonen | B66C 9/16 105/163.2 |
| 7,493,864 | B2 | 2/2009 | Corpelet | |
| 2011/0100753 | A1 | 5/2011 | Tarkiainen et al. | |
| 2011/0247993 | A1 | 10/2011 | Chernyak | |

FOREIGN PATENT DOCUMENTS

| | | | |
|---|---|---|---|
| CN | 2866436 | Y | 2/2007 |
| CN | 102389235 | A | 6/2011 |
| CN | 202220049 | U | 5/2012 |
| CN | 202369259 | U | 8/2012 |
| DE | 2748773 | A1 | 5/1978 |
| EP | 0960848 | A2 | 12/1999 |
| EP | 0960848 | B1 | 1/2004 |
| EP | 2824058 | A1 | 1/2015 |
| FI | 981191 | | 11/1999 |
| FR | 2004441 | A1 | 11/1969 |
| GB | 806770 | A | 12/1958 |
| JP | 48-56763 | U | 7/1973 |
| JP | 52-75747 | A | 6/1977 |
| JP | 61-191386 | U | 11/1986 |
| JP | S64-43085 | U | 3/1989 |
| JP | 2010-208817 | A | 9/2010 |
| JP | 2012-092537 | A | 5/2012 |
| KR | 90-282 | A | 1/1990 |

OTHER PUBLICATIONS

Written Opinion of the International Searching Authority, issued in PCT/FI2019/050298, PCT/ISA/237, dated Jun. 27, 2019.

Australian Office Action_2019254734—dated Oct. 8, 2021; pp. 1-11.

Extended European Search Report for European Application No. 19788899.3, dated Feb. 16, 2022.

* cited by examiner

BRIDGE CRANE ARRANGEMENT

BACKGROUND OF THE INVENTION

The invention relates to a bridge crane arrangement which comprises at least one main girder for a trolley, the main girder having a longitudinal central web which has at least one web plate, and a longitudinal bottom flange arranged in the bottom part of the central web and protruding from the central web onto both sides thereof; end girders which are adapted to support opposite ends of the main girder; wheels which are arranged to the end girders and intended to move the crane arrangement along substantially parallel guides which are transverse in relation to the main girder and thus to support the entire crane arrangement; slide means arranged between an end girder on at least one side and the corresponding end of the main girder, the slide means allowing the movement of the end girder in question in relation to the main girder in at least its longitudinal direction and the rotation of the end girder and main girder in relation to each other; and restricting means to restrict the movements between the end girder in question on one side and the main girder.

It is very common when it comes to bridge cranes that there exist the following conditions and situations that cause problems: Either or both of the crane guides, such as rails, may be curvy and therefore at the extreme limits of the allowed tolerances or even exceeding them. The distance between the rails may be undefined or varying, in particular in outdoor tracks or tracks arranged in halls that have a flexible frame structure. The distance between the crane tracks may change as a result of changes in the temperature, particularly as concerns outdoor cranes. The crane may have to be manufactured under such conditions in which the alignment of the bearing wheels cannot be guaranteed to be within tolerances.

For the aforementioned reasons, the travel of the crane may be difficult while the wear and tear on the wheels and rails is intense. To eliminate the problems that wear and tear on the rails cause, the need exists to keep the requirements for accuracy of manufacture high, which raises the costs considerably. Precise alignment of the rails, which reduces the wear and tear on the rails, increases the costs even more. In addition, a particular problem is caused by the drive means of the crane and their controls, which affects how straight the crane moves in various situations. In such a case, deflected movement may cause extensive problems.

A prior art bridge crane arrangement is described in publication EP 0960 848 B1. The slide means of the slide joint described in it comprise a slide plate arrangement installed on a top surface of an end girder and a bottom surface of the main girder, and having, as restricting means, a pin and slot arrangement extending inside the main girder. This solves the above problems rather well, but the drawback is its high cost, which has prevented its extensive application in the joint in question.

SUMMARY OF THE INVENTION

The goal of the invention is to develop the bridge crane arrangement in question so that the aforementioned drawbacks may be solved with lower manufacturing costs. This goal is achieved with the bridge crane arrangement according to the invention, which is characterised in that there is arranged, on the top surface of the end girder in question, a support platform wider than the bottom flange, in that the slide means comprise a slide surface arranged on the top surface of the support platform and/or the bottom surface of the bottom flange of the main girder, and in that restricting means are arranged to the support platform on both sides of the bottom flange of the main girder, outside the main girder. Preferred embodiments of the invention are disclosed in the dependent claims.

The invention is thus based on a slide joint far simpler than previously, consisting of a slide surface arrangement between the support platform and main girder and restricting means which are arranged on the support platform and separate from the main girder. This also allows the problems caused by tolerances on the length of the main girder to be reduced.

This slide joint is possible to implement afterwards on existing bridge cranes. Because the forming of slide surfaces does not much increase the height of the end on the side of the flexible joint of the crane, there will be no need for changes for the structure on the side of the fixed support on the opposite side of the crane. In addition, when all the means restricting the movement of the main girder are placed on the outside of the main girder, no changes will be required on the main girder, either.

All the parts that the slide joint needs are simple, so their manufacture is easy in a number of ways, such as laser cutting, which at the same time results in economical manufacturing costs. Similarly, installing a joint consisting of such parts is simple.

Insofar as the length of the main girder is concerned, a slightly longer main girder may be allowed, because the main girder may exceed past the joint. In practice, the exceeding is limited by the walls or support pillars of a building. Due to the exceeding, it is in most cases possible to use main girder parts of the same length without needing to cut them.

LIST OF FIGURES

Figure 3:
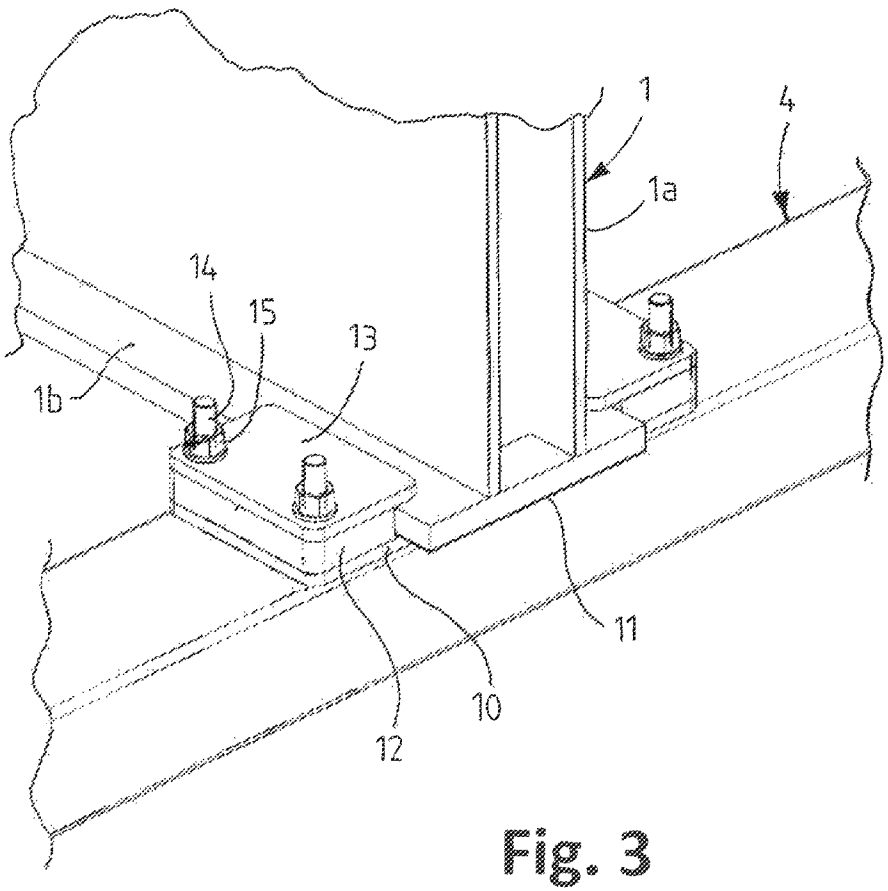
Figure 2:
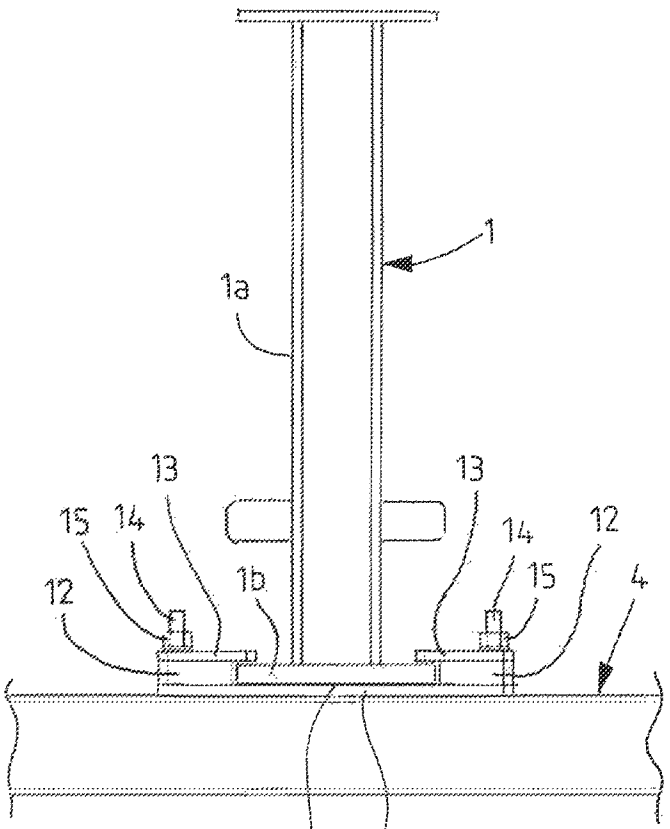

The invention will now be explained in more detail with reference to the accompanying drawings, in which FIG. 1 shows a bridge crane arrangement provided with one main girder as seen from below the guides intended for its movement;

FIG. 2 shows an advantageous inventive slide joint of a bridge crane arrangement, as seen in the longitudinal direction of the main girder; and FIG. 3 is a perspective view of the slide joint of FIG. 2.

DETAILED DESCRIPTION OF THE INVENTION

With reference to FIG. 1, there is shown the bridge crane arrangement according to the invention, which comprises a main girder 1, a trolley 2 moving on the main girder 1 or at least one hoisting apparatus (not shown) fixedly on it, end girders 3, 4 arranged on opposite ends of the main girder 1 and supporting the main girder 1, and wheels 5 arranged to the end girders, the wheels being intended to move along guides, such as rails 6 and 7, which are substantially parallel to the end girders 3 and 4 and, on the other hand, transverse in relation to the main girder 1, and thus to support the entire crane on said rails.

The main girder 1 has a longitudinal central web, which in this case has two web plates 1*a* at a distance from each other, and a longitudinal bottom flange 1*b* arranged in the bottom part of the central web and protruding from the central web on both sides thereof. The central web may also be a single plate one or of a profile type. This flange structure, typical for main girders, may be used to support the wheels (not shown) of the trolley 2 and thus to support the entire trolley 2 and a load fastened to it.

Between the end girder 4 on one side and the corresponding end 9 of the main girder 1, slide means are arranged, allowing the movement of the end girder 4 in question in relation to the main girder 1 in the longitudinal direction thereof, rotation of the end girder 4 in question and main girder 1 in relation to each other, as well as a small movement in the direction of the rail 7, as well as restricting means to restrict the movements between this end girder 4 on one side and the main girder 1. The second end 8 of the main girder 1 is, in turn, connected to a second end girder 3 by a normal, rigid joint controlling the crane, but if need be, it may also be arranged to slide as described in the above.

In accordance with FIGS. 2 and 3, there is arranged, on the top surface of the end girder 4, a support platform 10 wider than the bottom flange 1*b*, whereby the slide means comprise a slide surface 11 arranged on the top surface of the support platform 10 and/or the bottom surface of the bottom flange 1*b* of the main girder, and whereby restricting means, described below, are installed to the support platform 10 on both sides of the bottom flange 1*b* of the main girder, outside the main girder 1. The support platform 10 may also be a plate welded to the end girders.

The support platform 10 may also have been formed of different two plates so that it has a raised surface, preferably on the centre part. The slide surface 11 is in this case installed on top of said centre part. The raised portion may be accomplished in a number of ways, for example by milling the edge portions, or welding two superimposed plates of different sizes to each other, etc. So, the support platform may have a horizontal surface at two levels. Bolts 14 to be fixed penetrate the support platform 10 in the edge area having the lower level of the support platform 10, and the main girder rests on the upper level.

The slide surface 11 may be formed of tape having sliding characteristics, and having a core on top of which the slide surface 11 is arranged. The slide surface 11 may also be formed of a sprayable substance comprising sliding characteristics, which has been sprayed, painted, or coated on the top surface of the support platform 10 and/or on the bottom surface of the bottom flange 1*b* of the main girder, without a separate core. The maximum thickness of the slide surface is advantageously in the 3 to 5 mm range.

The restricting means comprise raising elements 12 installed on the top surface of the support platform 10 on both sides of the bottom flange 1*b* of the main girder 1, and cover parts 13 connected to the raising elements and extending on top of the bottom flange 1*b*. Between the bottom flange 1*b* and cover parts 13 a vertical gap may remain.

The raising elements 12 and cover parts 13 may be separate pieces, and the raising parts 12 may be formed of several plates one on top of the other. The raising elements 12 and cover part 13 may also be integrated into a uniform structure.

Between the side edges of the bottom flange 1*b* of the raising elements 12, a clearance has to be left which allows the main girder 1 to move in the longitudinal direction and the rotation of the main girder 1, within certain limits, in relation to the vertical axis of the end girder 4. The adapter between the bottom flange 1*b* of the cover parts 13 only needs to allow the aforementioned sliding. The purpose of the cover parts 13 is to prevent the main girder 1 from swaying around the longitudinal axis of the main girder. The shape of the raising elements 12 and cover parts 13 is not limited to the examples set forth, because the main issue is that they allow the aforementioned movement within the limits set for them.

The support platform 10 may be similar to the support platform for the rigid support on the end girder 3 on the other side, whereby the raising elements 12 and cover parts 13 may be fixed to he support platform 10 with bolts 14 and nuts 15 which are typically also used in the rigid support.

The above description of the invention is only intended to illustrate the implementation of the invention. A person skilled in the art may, however, implement its details within the scope of the attached claims. The invention is therefore suitable for use on a bridge crane comprising a plurality of main girders. In such a case, all the flexible joints must obviously be located on the same side of the crane, unless both sides are flexible.

The invention claimed is:

1. A bridge crane arrangement comprising:

at least one main girder for a trolley, the at least one main girder having a longitudinal central web which has at least one web plate, and a longitudinal bottom flange arranged in a bottom part of the longitudinal central web and protruding from the longitudinal central web onto both sides thereof;

at least two end girders adapted to support opposite ends of the at least one main girder;

wheels arranged to the at least two end girders and intended to move the bridge crane arrangement along substantially parallel guides which are transverse in relation to the at least one main girder and thus to support the entire bridge crane arrangement;

a slide arranged between an end girder of the at least two end girders on at least one side and a corresponding end of the at least one main girder, the slide allowing movement of said end girder of the at least two end girders in relation to the at least one main girder in at least a longitudinal direction thereof and rotation of said end girder of the at least two end girders and the at least one main girder in relation to each other; and a restrictor configured to restrict the movements between said end girder of the at least two end girders and the at least one main girder, wherein on a top surface of said end girder of the at least two end girders there is arranged a support platform wider than the longitudinal bottom flange, wherein the slide includes a slide surface arranged on a top surface of the support platform and/or a bottom surface of the longitudinal bottom flange of the at least one main girder, and wherein the restrictor is arranged to the support platform on both sides of the longitudinal bottom flange of the at least one main girder, outside the at least one main girder.

2. The bridge crane arrangement as claimed in claim 1, wherein the slide surface is formed of tape having sliding characteristics, and having a core structure on top of which the slide surface is arranged.

3. The bridge crane arrangement as claimed in claim 1, wherein the slide surface is formed of a sprayable substance comprising sliding characteristics, which has been sprayed, painted, or coated on the top surface of the support platform and/or on the bottom surface of the longitudinal bottom flange of the at least one main girder.

4. The bridge crane arrangement as claimed in claim 1, wherein the slide surface is adapted on a substantially horizontal plane.

5. The bridge crane arrangement as claimed in claim 1, wherein the restrictor comprises raising elements installed on the top surface of the support platform on both sides of the longitudinal bottom flange of the main girder, and cover parts connected to the raising elements and extending on top of the longitudinal bottom flange.

6. The bridge crane arrangement as claimed in claim 5, wherein the raising elements and cover parts are separate pieces.

7. The bridge crane arrangement as claimed in claim 6, wherein the raising elements are formed of a plurality of superimposed plates.

8. The bridge crane arrangement as claimed in claim 5, wherein the raising elements and cover parts are integrated into a uniform structure.

* * * * *